US005265501A

United States Patent [19]

Reyes

[11] Patent Number: 5,265,501

[45] Date of Patent: Nov. 30, 1993

[54] BOTTLE CAP OPENER

[76] Inventor: Gilbert Reyes, 1785 Popham Ave., Bronx, N.Y. 10453

[21] Appl. No.: 864,043

[22] Filed: Apr. 6, 1992

[51] Int. Cl.[5] ..... B67B 7/16

[52] U.S. Cl. ..... 81/3.08; 81/3.27; 81/3.15

[58] Field of Search ..... 81/3.08, 3.07, 3.15, 81/3.25, 3.27

[56] References Cited

U.S. PATENT DOCUMENTS

| | | | |
|---|---|---|---|
| 1,547,578 | 7/1925 | Frisone | 81/3.08 |
| 1,929,855 | 10/1933 | Saal | 81/3.08 |
| 2,029,804 | 2/1936 | Williamson | 81/3.08 |
| 2,090,714 | 8/1937 | Wright et al. | 81/3.08 |
| 2,454,531 | 11/1948 | Van Trine | 81/3.08 |
| 2,556,268 | 6/1951 | Gilbert | 81/3.08 |
| 2,649,004 | 8/1953 | Trimble, Sr. et al. | 81/3.08 |

FOREIGN PATENT DOCUMENTS

| | | | |
|---|---|---|---|
| 0466786 | 7/1950 | Canada | 81/3.15 |
| 0296593 | 9/1928 | United Kingdom | 81/3.15 |

*Primary Examiner*—Roscoe V. Parker
*Attorney, Agent, or Firm*—Michael I. Kroll

[57] ABSTRACT

An improved bottle cap opener is provided which consists of a housing having an open top and an open bottom. A mechanism is for mounting the housing to a flat vertical surface. A structure at the open top of the housing is for removing a cap from a bottle. A device at the open bottom of the housing is for catching the cap after it is removed from the bottle, so as to keep the area about the opener clean, while caps can be collected for possible recycling.

15 Claims, 1 Drawing Sheet

BOTTLE CAP OPENER

BACKGROUND OF THE INVENTION

1. Field of the Invention

The instant invention relates generally to bottle openers and more specifically it relates to an improved bottle cap opener.

2. Description of the Prior Art

Numerous bottle openers have been provided in prior art that are adapted to remove the caps from bottles and drop them onto a floor or counter top. While these units may be suitable for the particular purpose to which they address, they would not be as suitable for the purposes of the present invention as heretofore described.

SUMMARY OF THE INVENTION

A primary object of the present invention is to provide an improved bottle cap opener that will overcome the shortcomings of the prior art devices.

Another object is to provide an improved bottle cap opener that includes a detachable bag connected thereto, so as to catch all of the caps removed from bottles to keep the area about the opener clean while the caps can be collected for possible recycling.

An additional object is to provide an improved bottle cap opener that includes an elongated cap removal member, so that it will be able to open two bottles simultaneously allowing a person using the opener to save time.

A further object is to provide an improved bottle cap opener that is simple and easy to use.

A still further object is to provide an improved bottle cap opener that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
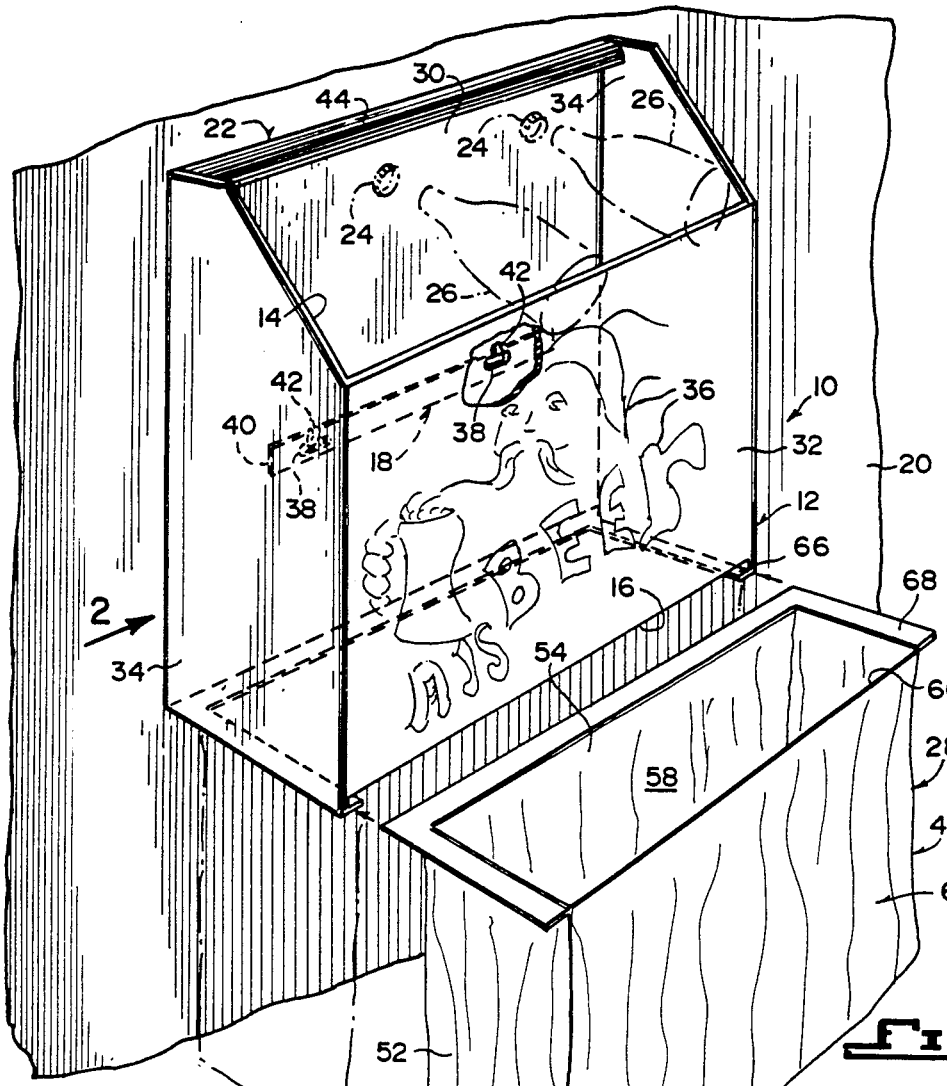
FIG. 1 is a perspective view of the instant invention mounted to a wall and showing the bag ready to be inserted thereon.
Figure 2:
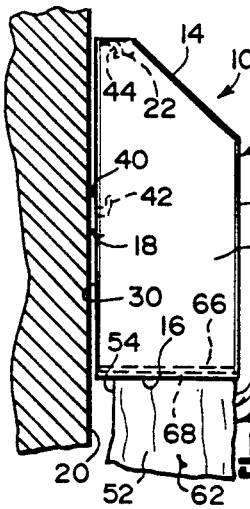
FIG. 2 is a side view taken in direction of arrow 2 in FIG. 1 with the bag connected thereto and broken away.
Figure 3:
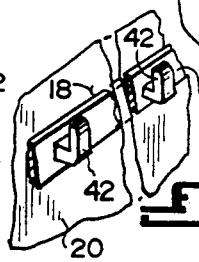
FIG. 3 is a perspective view with parts broken away showing the mounting bracket in greater detail.
Figure 4:
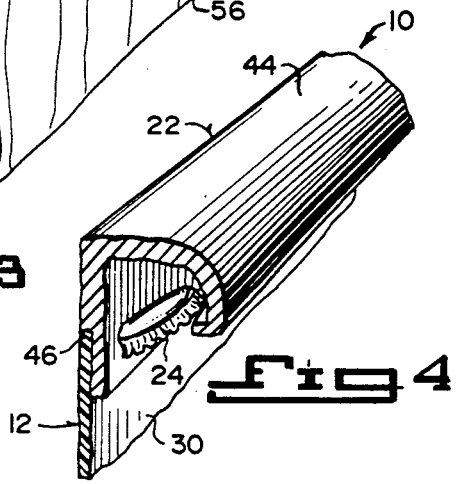
FIG. 4 is an enlarged perspective view with parts broken away of the elongated cap removal member attached to the upper edge on the rear wall of the housing.

Turning now descriptively to the drawings, in which similar reference characters denote similar elements throughout the several views, the Figures illustrate an improved bottle cap opener 10 which consists of a housing 12 having an open top 14 and an open bottom 16. A mechanism 18 is for mounting the housing 12 to a flat vertical surface 20, such as a wall. A structure 22 at the open top of the housing 12 is for removing a cap 24 from a bottle 26. A device 28 at the open bottom 16 of the housing 12, is for catching the cap 24 after it is removed from the bottle 26, so as to keep the area about the opener 10 clean, while caps 24 can be collected for possible recycling.

The housing 12 includes a rear wall 30, a front wall 32 and a pair of side walls 34. Each side wall 34 extends between one edge of the rear wall 30 and the front wall 32. The front wall 32 is shorter in height than the rear wall 30, so that the bottle 26 can fit therethrough when inserted into the open top 14 to allow the cap 24 to engage with the cap removing structure 22. Indicia 36 is placed upon the front wall 32 of the housing 12 for advertising various products therefrom.

The mounting mechanism 18 includes the rear wall 30 of the housing 12 having a pair of spaced apart inverted T-shaped slots 38 therein. An elongated rectangular plate 40 is affixed horizontally to the flat vertical surface 20 by any conventional fastener. A pair of spaced apart upwardly extending cleats 42 are secured to the elongated rectangular plate 40 to receive the inverted T-shaped slots 38 on the rear wall 30 of the housing 12.

The cap removing structure 22 includes an elongated downwardly curved hook member 4 attached to an upper edge 46 on the rear wall 30 of the housing 12, so that the caps 24 on two bottles 26 can be removed simultaneously allowing the person using the opener 10 to save time.

The catching device 28 is a container 48 having a bottom wall 50, a pair of side walls 52, a rear wall 54 and a front wall 56 forming a compartment 58 with a mouth 58 to receive the caps 24 therein. The container 48 is a flexible bag 62.

The improved bottle cap opener 10, further includes an apparatus 64 for removably attaching the mouth 60 of the flexible bag 62 to the open bottom 16 of the housing 12, so that the collected caps 24 can be removed from the opener 10. The removably attaching apparatus 64 contains a generally C-shaped track 66 formed on a lower edge of the rear wall 30 and each of the side walls 34 of the housing 12. A generally C-shaped flange 68 is affixed onto an upper edge of the bag 62 about the mouth, 60, so that the flange 68 can slide into and out of the track 66 when needed.

The rear wall 30, the front wall 32 and the side walls 34 of the housing 12 are fabricated out of a durable plastic material. The elongated rectangular plate 4 and the upwardly extending cleats 42 are fabricated out of a durable metal material. The elongated downwardly curved hook member 44 is fabricated out of a durable metal material. The generally C-shaped track 66 and the generally C-shaped flange 68 are both fabricated out of a durable plastic material, while the flexible bag 62 is fabricated out of plastic or paper material.

To use the improved bottle cap opener 10 the following steps should be taken 1. Affix the elongated rectangular plate 40 horizontally to the flat vertical surface 20, so that the cleats 42 are upwardly extending.

2. Place the inverted T-shaped slots 38 on the rear wall 30 of the housing 12 onto the cleats 42.

3. Slide the generally C-shaped flange 68 on the upper edge of the bag 62 into the track 66 on the housing 12.

4. Place the two caps 24 on the two bottles 26 into the elongated downwardly curved hook member 44 and remove the caps 24, so that they drop into the compartment 58.

5. Remove the generally C-shaped flange 68 on the upper edge of the bag 62 from the track 66 on the housing 12, when the bag 62 become full of caps 24.

6. Dispose the bag 62 with the caps 24 in a proper manner, so that the caps 24 may be recycled if need be.

LIST OF REFERENCE NUMBERS

10—improved bottle cap opener
12—housing
14—open top of 12
16—open bottom of 12
18—mounting mechanism
20—flat vertical surface
22—cap removing structure
24—cap
26—bottle
28—catching device
30—rear wall of 12
32—front wall of 12
34—side wall of 12
36—indicia on 32
38—inverted T-shaped slot in 30
40—elongated rectangular plate
42—upwardly extending cleat
44—elongated downwardly curved hook member for
46—upper edge on 30
48—container for 28
50—bottom wall of 48
52—side wall of 48
54—rear wall of 48
56—front wall of 48
58—compartment in 48
60—mouth on 48
62—flexible bag for 48
64—removably attaching apparatus
66—generally C-shaped track
68—generally C-shaped flange It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved bottle cap opener which comprises:

a) a housing having an open top large enough for at least a pair of bottles to fit through and an open bottom, said housing includes a rear wall, a front wall and a pair of side walls, each extending between one edge of said rear wall and said front wall, said front wall is shorter in height than said rear wall, so that the bottles can fit therethrough when inserted into the open top to allow the cap to engage with said cap removing means;

b) means for mounting said housing to any flat vertical surface without any demolition required of said flat vertical surface;

c) means at the open top of said housing, for removing at least a pair of caps simultaneously from at least a pair of bottles; and d) means at said open bottom of said housing, for catching each cap after it is removed from each bottle, so as to keep the area about said opener clean, while caps can be collected for possible recycling, said catching means being flush with said flat vertical surface without any demolition required of said flat vertical surface.

2. An improved bottle cap opener as recited in claim 1, further including indicia placed upon said front wall of said housing for advertising various products therefrom.

3. An improved bottle cap opener as recited in claim 2, wherein said mounting means includes:

a) said rear wall of said housing having a pair of spaced apart inverted T-shaped slots therein;

b) an elongated rectangular plate affixed horizontally to the flat vertical surface; and c) a pair of spaced apart upwardly extending cleats secured to said elongated rectangular plate to receive said inverted T-shaped slots on said rear wall of said housing.

4. An improved bottle cap opener as recited in claim 3, wherein said cap removing means includes an elongated downwardly curved hook member attached to an upper edge of said rear wall of said housing, so that the caps on two bottles can be removed simultaneously allowing the person using said opener to save time.

5. An improved bottle cap opener as recited in claim 4, wherein said catching means includes a container having a bottom wall, a pair of side walls, a rear wall and a front wall forming a compartment with a mouth to receive the caps therein.

6. An improved bottle cap opener as recited in claim 5, wherein said container is a flexible bag.

7. An improved bottle cap opener as recited in claim 6, further including means for removably attaching the mouth of said flexible bag to the open bottom of said housing, so that the collected caps can be removed from said opener.

8. An improved bottle cap opener as recited in claim 7, wherein said removably attaching means includes:

a) a generally C-shaped track formed on a lower edge of said rear wall and each of said side walls of said housing; and b) a generally C-shaped flange affixed onto an upper edge of said bag about the mouth, so that said flange can slide into and out of said track when needed.

9. An improved bottle cap opener as recited in claim 8, wherein said rear wall, said front wall and said side walls of said housing are fabricated out of a durable plastic material.

10. An improved bottle cap opener as recited in claim 9, wherein said elongated rectangular plate and said upwardly extending cleats are fabricated out of a durable metal material.

11. An improved bottle cap opener as recited in claim 10, wherein said elongated downwardly curved hook member is fabricated out of a durable metal material.

12. An improved bottle cap opener as recited in claim 11, wherein said generally C-shaped track is fabricated out of a durable plastic material.

13. An improved bottle cap opener as recited in claim 12, wherein said generally C-shaped flange is fabricated out of a durable plastic material.

14. An improved bottle cap opener as recited in claim 13, wherein said flexible bag is fabricated out of plastic material.

15. An improved bottle cap opener as recited in claim 13, wherein said flexible bag is fabricated out of paper material.

* * * * *